US007331295B1

(12) United States Patent
Marchiori

(10) Patent No.: US 7,331,295 B1
(45) Date of Patent: Feb. 19, 2008

(54) RAILCAR DOOR OPERATING MECHANISM WITH PISTON LOCK

(76) Inventor: David Marchiori, 5896 Old Camp Bullis Rd., San Antonio, TX (US) 78257

( * ) Notice: Subject to any disclaimer, the term of this patent is extended or adjusted under 35 U.S.C. 154(b) by 233 days.

(21) Appl. No.: 11/062,134

(22) Filed: Feb. 17, 2005

Related U.S. Application Data

(60) Provisional application No. 60/545,263, filed on Feb. 17, 2004.

(51) Int. Cl.
*B61D 3/00* (2006.01)

(52) U.S. Cl. ..... 105/286

(58) Field of Classification Search ..... 105/286, 105/288, 289, 290
See application file for complete search history.

(56) References Cited

U.S. PATENT DOCUMENTS 4,284,011 A * 8/1981 Eagle ..... 105/310

* cited by examiner

*Primary Examiner*—S. Joseph Morano
*Assistant Examiner*—Robert J. McCarry, Jr.
(74) *Attorney, Agent, or Firm*—Booth Udall, PLC

(57) ABSTRACT

A railcar door operating mechanism with piston lock used for opening, closing and locking a railcar door. The railcar door operating mechanism may include a hydraulic piston, a piston lock, a lock drive, and a lock drive piston. To open a railcar door the lock drive piston extends and causes movement of the lock drive. The lock drive then engages the piston lock and moves the piston lock from a locked position to an unlocked position. Once the piston lock is in an unlocked position, the hydraulic piston is then retracted to open the railcar door. To close the railcar door, the hydraulic piston is again activated extending the hydraulic piston to close the railcar door. The lock drive piston may then retract and cause movement of the lock drive. The lock drive may again engage the piston lock and move the piston lock into a locked position.

18 Claims, 7 Drawing Sheets

RAILCAR DOOR OPERATING MECHANISM WITH PISTON LOCK

CROSS REFERENCE TO RELATED APPLICATION

This application claims priority to U.S. Provisional Patent Application to David Paul Marchiori entitled "Cylinder Lock," Ser. No. 60/545,263, filed Feb. 17, 2004, the disclosure of which is hereby incorporated entirely herein by reference.

BACKGROUND OF THE INVENTION

1. Technical Field

This invention relates generally to a mechanism for opening, closing and locking railcar doors, and more specifically to a mechanism for opening, closing and locking rapid discharge railcar doors located on or near the bottom of a railcar.

2. State of the Art

A common type of railroad freight car used today is an open-top hopper car wherein the commodity carried by the railcar is discharged through an opening provided on the underside of the car. Such cars are used to haul aggregate, iron ore, coal and other commodities. Such cars offer an advantageously economical method of transporting large amounts of a commodity between locations.

Conventionally, when a hopper car arrives to deliver its load, technicians open its doors. The conventional way to open the door is by striking the railcar door latch in an upward direction with a large sledgehammer. For each door, there is a latch at each side of the door (two latches per door set). The striking motion must be accurate for each latch to move to the open position. Often, it takes multiple strikes of a hammer to release each latch, allowing the doors to open and dispatch the material.

The technician opening the door in this conventional way is exposed to many hazards. The surface he is standing on, through which the transported commodity falls, is generally a grate of various dimensions of spacing; an estimated average is an opening of approximately six inches square. The grate is necessary for the material to flow through to a storage container or hopper located under the grate. The grate creates a hazard for the technician, and the industry has experienced an unacceptably large number of accidents related to human extremities slipping through the grate while technicians open the doors. Additionally, strikes missing the latches while attempting to deliver strikes powerful enough to move the latches can result in the technicians loosing their balance, falling and sustaining various other injuries.

To close the doors, the technician again stands on the grate through which the material flows. While on this grate, the technician is required to insert a heavy steel bar through a rung on the car hopper door, and then pry the door up to the latch of the railcar door. This action is repeated for each side of each door set. When the hopper doors are bent or out of square, which is common because the doors are generally opened one side at a time causing torsional stresses on the door from the weight of the commodity above the door, the technician is required to use additional force to bend the doors closed. This action while standing on the grate creates additional hazards for the technicians, and the industry has experienced an unacceptably large number of accidents related to human extremities falling through this grate while technicians close the doors. Many back injuries are also sustained.

Accordingly, what is needed is a mechanism that will open and close a railcar door with limited or no technician intervention and will replace the currently difficult and dangerous to operate door latches.

DISCLOSURE OF THE INVENTION

The present invention relates to a mechanism for opening, closing and locking a railcar door. Embodiments of the invention provide a railcar door operating mechanism with a piston lock that is coupled to an existing railcar to serve as the opening, closing and locking device of the railcar door. The system is intended to replace current devices that open, close and lock railcar doors.

In a particular embodiment, the railcar door operating mechanism includes a hydraulic piston, a piston lock, a lock drive, and a lock drive piston. To open the railcar door, the lock drive piston extends and causes movement of the lock drive. The lock drive engages the piston lock and moves the piston lock from a locked position to an unlocked position. Once the piston lock is in an unlocked position, the hydraulic piston is activated. The hydraulic piston is retracted and the railcar door is opened, thereby allowing the dumping of the commodity being transported within the railcar. After the railcar is emptied, the hydraulic piston is again activated, whereby the hydraulic piston is extended and the railcar door is closed. The lock drive piston then retracts and causes movement of the lock drive. The lock drive again engages the piston lock and moves the piston lock into a locked position.

Additionally, in other particular embodiments, the railcar door operating mechanism includes a hydraulic piston, a piston lock/lock drive combination, a piston stop and a lock drive piston. In these particular embodiments the piston lock and lock drive may be combined into a single component, which engages the piston stop in order to lock the railcar door in a closed position.

The railcar door operating mechanism with piston lock may be used individually for each railcar door, or it may be used in conjunction with a plurality of mechanisms to provide the sufficient force necessary to operate that particular railcar door.

The foregoing and other features and advantages of the present invention will be apparent from the following more detailed description of the particular embodiments of the invention, as illustrated in the accompanying drawings.

BRIEF DESCRIPTION OF THE DRAWINGS

It should be understood that the drawing figures are not drawn to actual dimensions, sizes and proportions for the particular embodiments of the present invention, and are therefore not a limitation of the present invention.

DETAILED DESCRIPTION OF EMBODIMENTS OF THE INVENTION

As discussed above, embodiments of the present invention relate to a mechanism for opening, closing and locking a railcar door. Embodiments are particularly useful for railcar configurations wherein the railcar doors are underneath the railcar and are difficult to operate safely. Embodiments of the railcar door operating mechanism of the present invention may be coupled to an existing railcar to serve as the opening, closing and locking device of the railcar door, thereby replacing current devices to performs such tasks. Alternatively, embodiments of the railcar door operating mechanism may be incorporated into new railcars.

Figure 1:
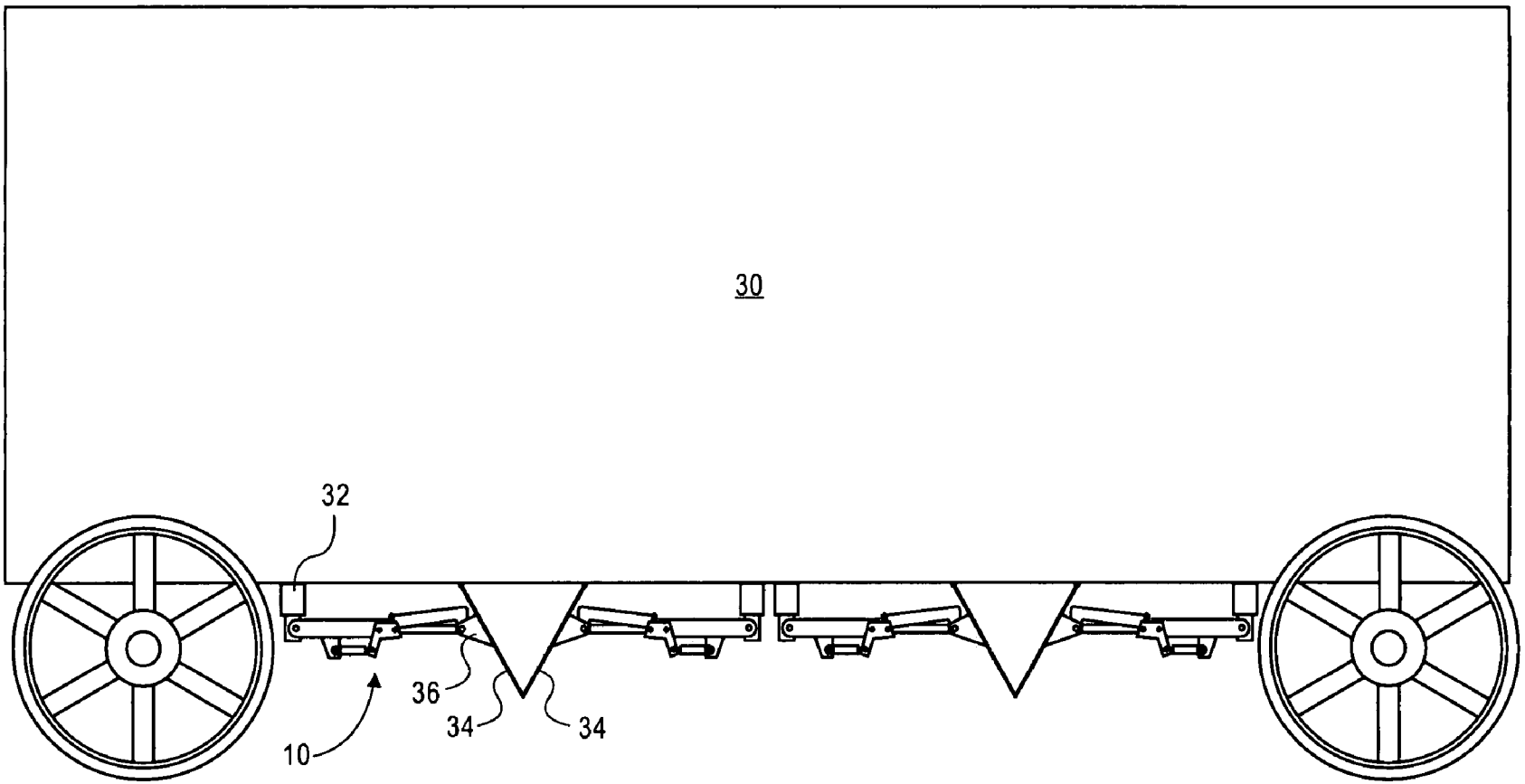
FIG. 1 is a side view of a plurality of railcar door operating mechanisms coupled to a railcar.

As shown in FIG. 1, a railcar door operating mechanism 10 may be coupled to a railcar 30 at a frame portion 32 and at the railcar door 34 by use of doorplate 36. It will be understood by those of ordinary skill in the art that a plurality of mechanisms 10 may be coupled to a railcar 30 dependent upon the number of railcar doors 34 on a particular railcar 30. It will also be understood that while in particular embodiments of the present invention one mechanism 10 may be used for each railcar door 34, that a plurality of mechanisms 10 may be employed on each railcar door 34. Additionally, various sizes of mechanisms may be employed on a railcar 30 dependent upon the required force needed to open the railcar door 34.

Generally, a particular embodiment of the operating mechanism 10, as shown in FIG. 1, operates a hydraulic piston to open the railcar door 34 and dump the load carried by the railcar 30 out of the bottom of railcar 30. When the load is emptied, the operating mechanism 10 then closes the railcar door 34 and locks it in closed position. This locking of the operating mechanism 10 is used in place of conventional latches that retain the railcar door 34 in a closed position. The operating mechanism 10 remains locked even in situations where there is a loss of power, such as, but not limited to a loss of hydraulic pressure.

Figure 2:
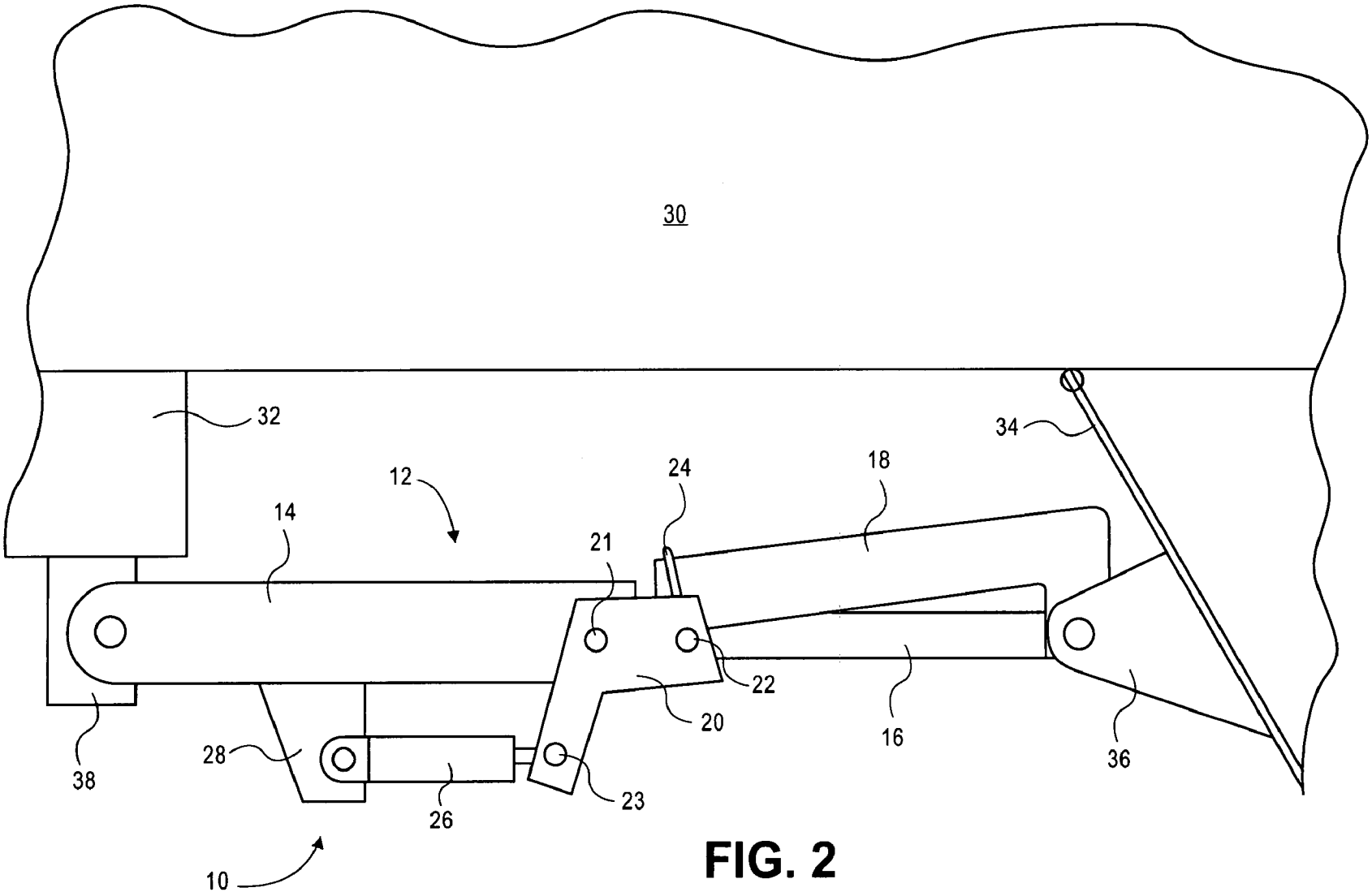
FIG. 2 is a side view of a railcar door operating mechanism in a locked position.

With reference to FIG. 2, a close-up view of operating mechanism 10 of the present invention is shown coupled to railcar 30. According to a particular embodiment of the invention, the operating mechanism 10 comprises a hydraulic piston 12, a piston lock 18, a lock drive 20 and a lock drive piston 26. In the particular embodiment shown in FIG. 2, the hydraulic piston 12 comprises a barrel 14 and a rod 16 and the lock drive 20 comprises a hinge pin 21, a lift guide 22, a connecting rod 23 and a lock guide 24. However, it will be understood by those of ordinary skill in the art that the lock drive 20 may incorporate any type of movement, such as but not limited to pivoting, rotating, linear translation and the like. It will also be understood that the lock drive 20 may also comprise a fork, a ring, a collar, a collet, a four-bar mechanism, a moveable apparatus, and any combination thereof, which can transfer its movement into the movement of the piston lock 18. The operating mechanism 10 may be coupled at the barrel 14 to a frame-plate 38, whereby the frame-plate 38 is coupled to a frame portion 32, or the barrel 14 may be coupled directly to the frame or other existing structure on the railcar to provide proper placement of the operating mechanism 10. The operating mechanism 10 may also be coupled to a doorplate 36, the doorplate 36 being coupled to the railcar door 34.

According to a particular embodiment of the present invention, the operating mechanism 10 is shown in FIG. 2 with the railcar door 34 in a closed position. To maintain railcar door 34 in a closed position for this embodiment, hydraulic piston 12 is extended, wherein the rod 16 is extended out of the barrel 14. The piston lock 18 is in a locked position preventing hydraulic piston 12 from moving into an open position and opening railcar door 34. The lock drive piston 26 is in a first position, thereby rotating lock drive 20 into a first position, such that lock guide 24 engages the piston lock 18 and retains the piston lock 18 in a locked position. It should be appreciated by those of ordinary skill in the art that the operating mechanism 10 will remain locked, keeping the railcar door 34 closed, even if hydraulic pressure is lost in the hydraulic piston 12 and lock drive piston 26. While FIG. 2 shows the operating mechanism 10 in a closed position with the hydraulic piston 12 in an extended position, the operating mechanism 10 may also use a retracted position to hold the railcar door 34 in a closed position, wherein the rod 16 is retracted within the barrel 14. In such cases, the operating mechanism 10 may be oriented such that the hydraulic piston 12 is coupled to a frame portion of the railcar 30 on a side of the railcar door 34 such that the railcar door 34 opens away from the operating mechanism 10. Additionally, the lock drive piston 26 may be in an extended position in order to retain piston lock 18 in a locked position. For example, the lock drive piston 26 may be coupled to the railcar door 34 while the remaining components of the operating mechanism 10 are oriented as shown in FIG. 2, thereby requiring the lock drive piston 26 to be extended to retain piston lock 18 in the locked position.

Figure 3:
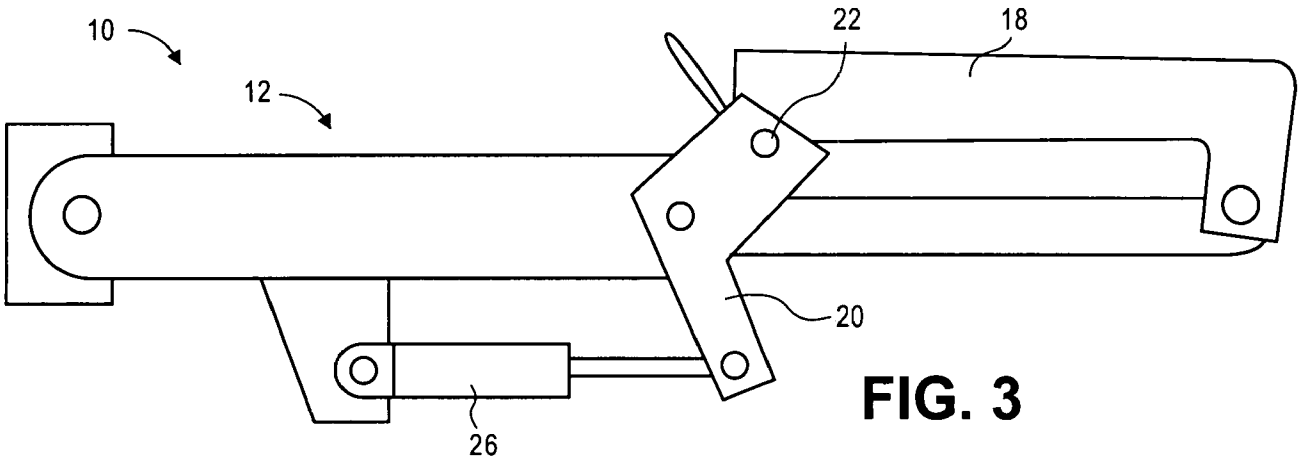
FIG. 3 is a side view of a railcar door operating mechanism with a piston lock in an unlocked position.
Figure 4:
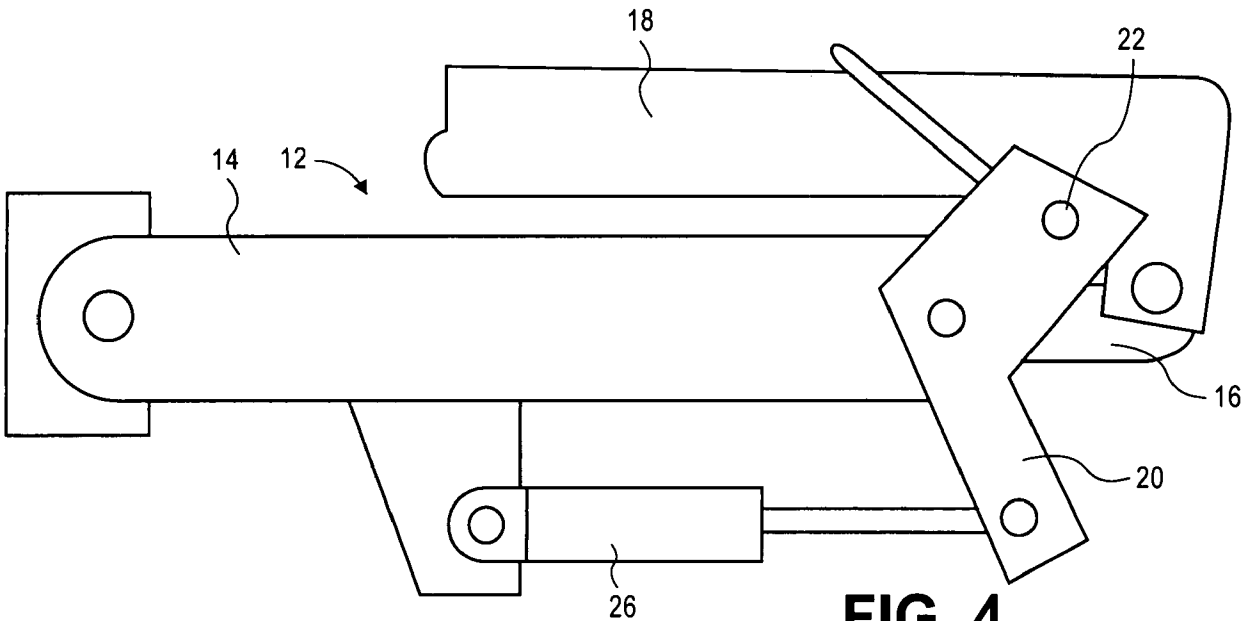
FIG. 4 is a side view of a railcar door operating mechanism with the hydraulic piston retracted.

Referring now to FIGS. 3 and 4, the operating mechanism 10 is shown with the piston lock 18 in an unlocked position and the entire operating mechanism 10 in an open position respectively. To unlock the embodiment of the operating mechanism 10 shown in FIGS. 3 and 4, lock drive piston 26 is moved to a second position, thereby rotating lock drive 20 into a second position. While the lock drive 20 rotates, lift guides 22 direct the piston lock 18 from its locked position to an unlocked position free from interference with hydraulic piston 12. The hydraulic piston 12 is then activated and moves into an open position. The lock drive piston 26 stays extended and the lock drive 20 stays rotated in the second position wherein the piston lock 18 is resting on the lift guides 22. As the hydraulic piston 12 moves into the open position, the piston lock 18 travels with the movement of rod 16 while the lift guides maintain a proper clearance of the piston lock 18, free from interference of the barrel 14 or any other part of the hydraulic piston 12. This movement into an open position of the hydraulic piston 12 opens the railcar door 34 and allows commodity within the railcar 30 to be unloaded.

After the commodity is unloaded, the operating mechanism 10 may then go through a reverse process whereby the hydraulic piston 12 is moved into a closed position to close the railcar door 34. When the hydraulic piston 12 reaches its fully closed position, determined by the closing of the railcar door 34, the lock drive piston 26 is activated and moves into the first position, rotating the lock drive 20 into the first position. As the lock drive 20 rotates, the lock guide 24 directs the piston lock 18 through its rotation into a locked position, and retains the piston lock 18 in a locked position. It will be recognized by those of ordinary skill that while particular embodiments of the present invention show that opening of the railcar door 34 accomplished by the retracting of the hydraulic piston 12 and the closing of the railcar door 34 accomplished by the extending of the hydraulic piston 12, other embodiments may be adapted such that the extending of the hydraulic piston 12 opens the railcar door 34 and the retracting of the hydraulic piston 12 closed the railcar door 34. In such cases, the operating mechanism 10 may be oriented such that the hydraulic piston 12 is coupled to a frame portion of the railcar 30 on the opposing side of the railcar door 34 such that the railcar door 34 opens away from the operating mechanism 10.

Figure 7:
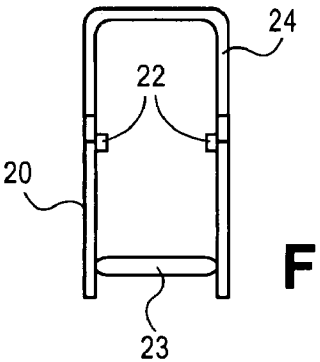
FIG. 7 is an end view of a lock drive of FIG. 5.
Figure 6:
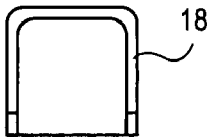
FIG. 6 is an end view of the piston lock of FIG. 5.
Figure 5:
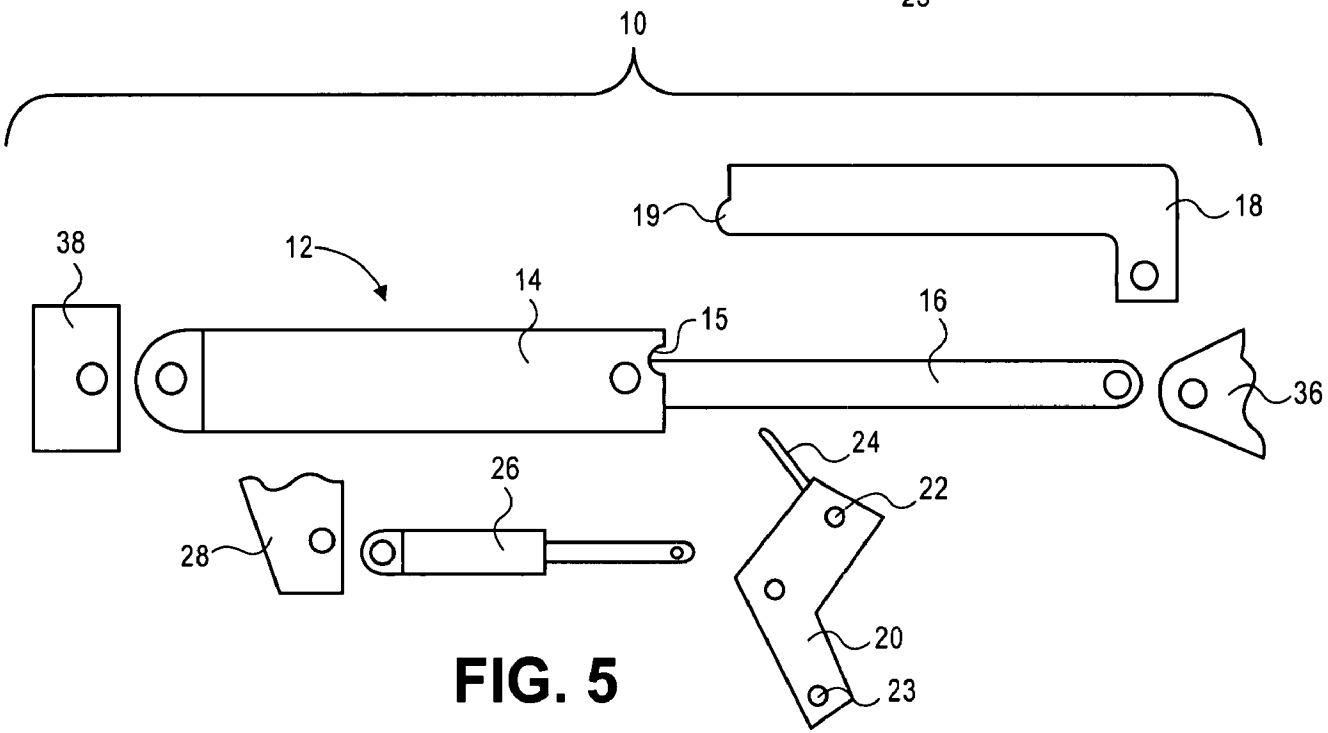
FIG. 5 is an exploded side view of a railcar door operating mechanism with a piston lock.

Referring to FIGS. 5-7, particular embodiments of the present invention may include an operating mechanism 10 comprising a hydraulic piston 12, a piston lock 18, a lock drive 20, a lock drive piston 26, frame-plates 28 and 38 and a doorplate 36. Further, the hydraulic piston 12 may comprise a barrel 14 and a rod 16. The barrel 14 may comprise a seat 15 and the piston lock 18 may comprise a corresponding protrusion 19, such that when the piston lock 18 is in a locked position, the protrusion 19 is pressure fit into the seat 15 thereby impeding easy unlocking of the piston lock 18. The use of a seat 15 associated with a protrusion 19 is not fundamental to the functioning of the operating mechanism 10, but may be employed to reduce the risk of accidental release and unintentional unlocking of the piston lock 18. The use of seat 15 and protrusion 19 may also be used as a trigger to determine when the piston lock 18 is fully in place, so as to stop the activation and movement of the hydraulic piston 12 and the lock drive piston 26. Additionally, the piston lock 18 may comprise a channeled, lever arm that provides for an over-center lever to lock the hydraulic piston on opposing sides of the rod 16 for a more efficient locking scheme. As will be understood by those skilled in the art that other components that perform the same functions may be used and perform equally well.

It should be specifically understood by those of ordinary skill that while shown to share the same pivot point as that of the rod 16, the piston lock 18 may have its own independent pivot point without compromising the functionality. The piston lock 18 is not limited to a channeled lever arm, but may also be a solid piece or a partial channel. The piston lock 18 may also be off-center while still providing the same locking ability on hydraulic piston 12. Also, while the piston lock 18 is shown to be a lever arm, it may be any type of piston lock with any type of movement and is not limited to pivoting, such as, but not limited to a fork, a ring, a collar, a collet, a chuck, a pin and any other part type that is moveable between a locked and an unlocked position.

The lock drive 20 may comprise a lift arm. The lock drive 20 shown in FIGS. 5-7 comprises lift guides 22, a lock guide 24 and a connecting rod 23 to connect to the lock drive piston 26. The lift guides 22 are shown as knobs that are used to lift the piston lock 18, however, they may be adapted to aid in the movement of the piston lock 18 dependent upon the type of movement piston 18 requires to move between a locked and an unlocked position. The lock drive 20 may also comprise one of a fork, a ring, a four-bar mechanism, a collar, a collet, a cam and any combination thereof wherein the lock drive 20 is moveable between a first and second position. The first position is associated with the locked position of the piston lock 18 and the second position is associated with the unlocked position of the piston lock 18.

The lock guide 24 is shown in FIGS. 5-7 as a loop that is of the size and shape to receive the piston lock 18. The lock guide 24 is not limited to this type of loop as shown in FIG. 7, but may be of any shape, size or design, so long as the lock guide can provide the necessary force to move the piston lock 18 into a locked position.

It will be understood that while the lock drive 20 may be operated by use of the lock drive piston 26, that it may also be operated manually. The lock drive may also be operated using a pneumatic piston, an air-powered quick release, a reversible magnetic loop and any other form of providing movement to the lock drive 20. Additionally, it may be coupled to the hydraulic piston 12 at the barrel 14 or directly to the railcar, to the rod 16, the piston lock 18 or any other part whereby the lock drive 20 may operate the piston lock 18. It will also be understood that the lock drive 20 and therefore the piston lock 18 may be inverted such that the lift guides 22 push the piston lock down to the unlocked and the lock guide 24 lifts the piston lock 18 into the locked position.

Figure 8:
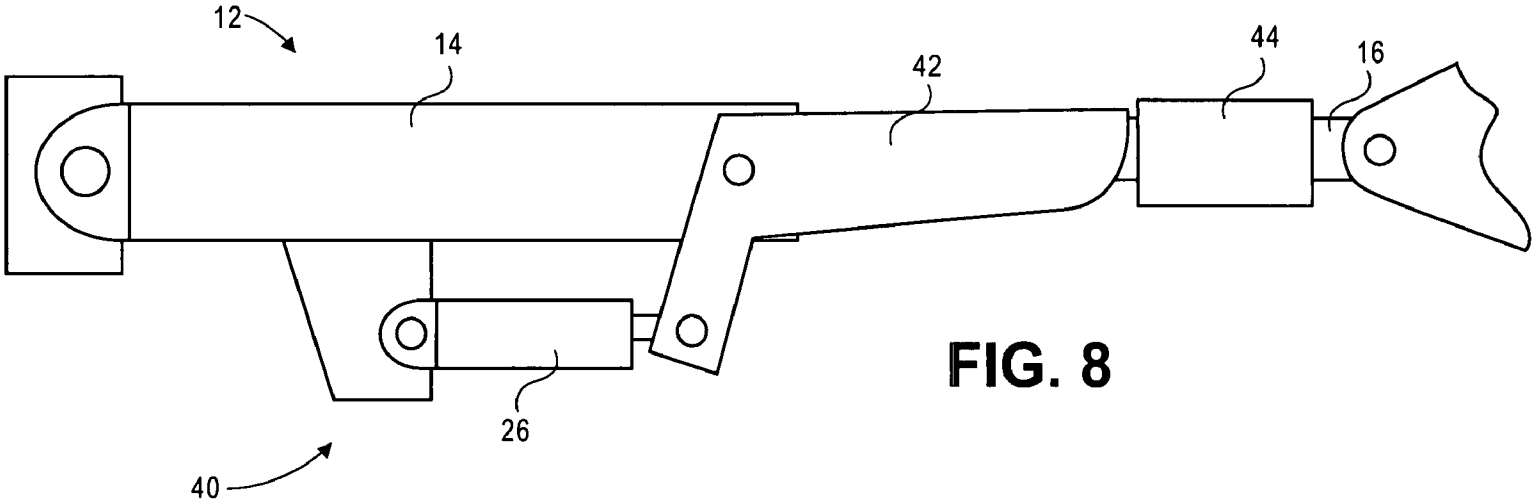
FIG. 8 is a side view of a railcar door operating mechanism with an integrated piston lock/lock drive in an extended position.
Figure 9:
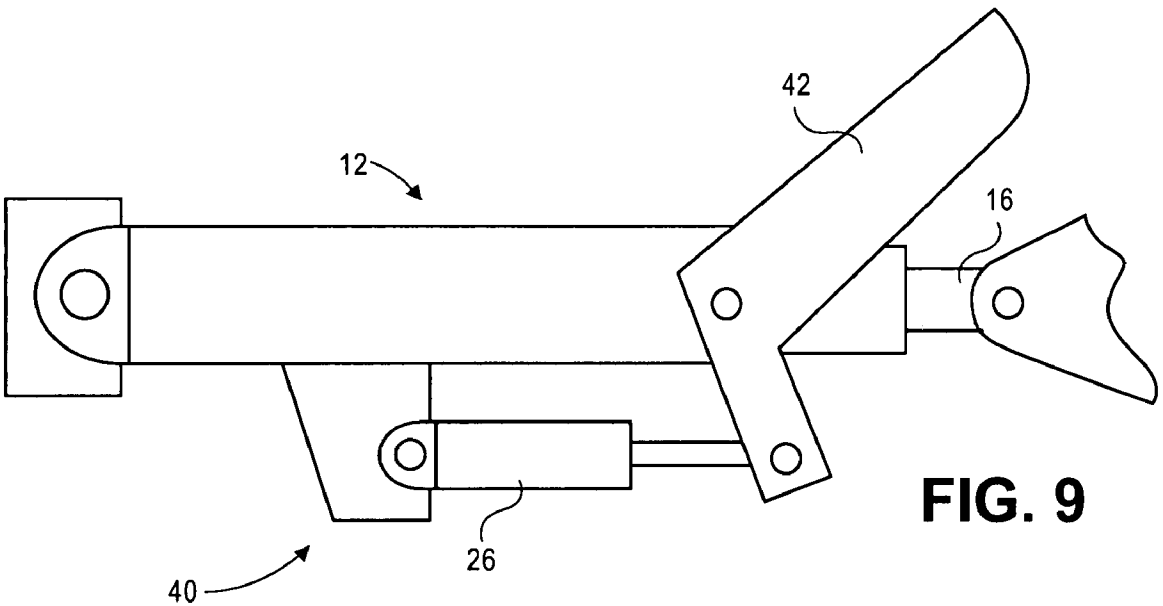
FIG. 9 is a side view of a railcar door operating mechanism with an integrated piston lock/lock drive in a retracted position.
Figure 10:
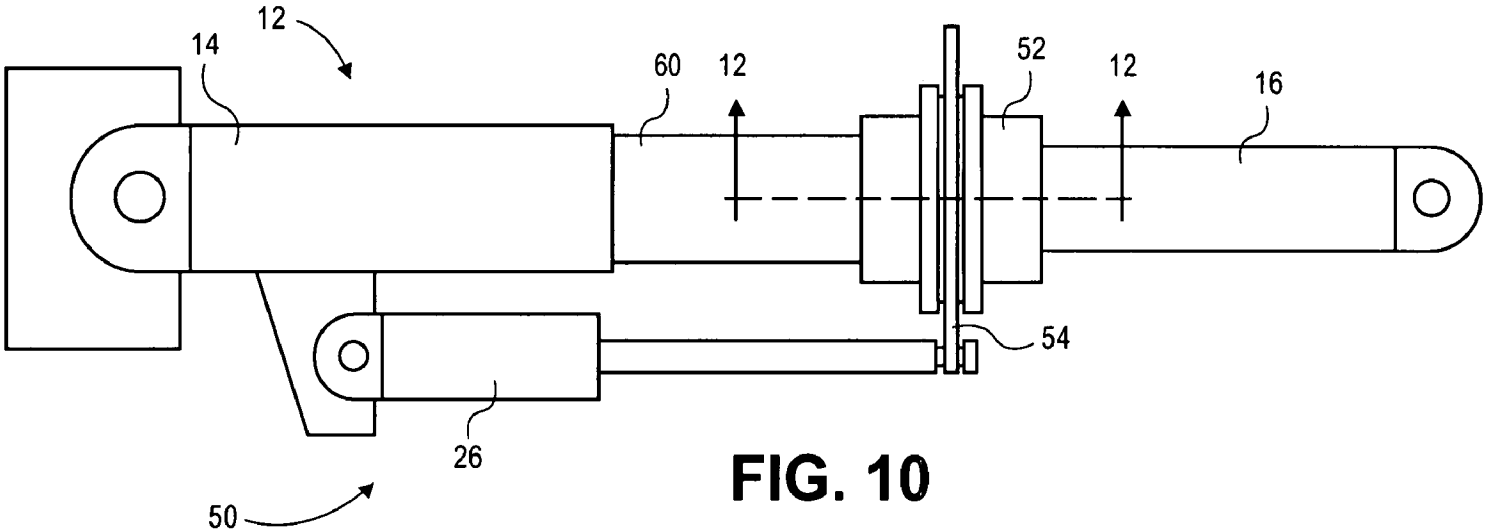
FIG. 10 is a side view of a railcar door operating mechanism with a piston lock collar in a extended position.
Figure 11:
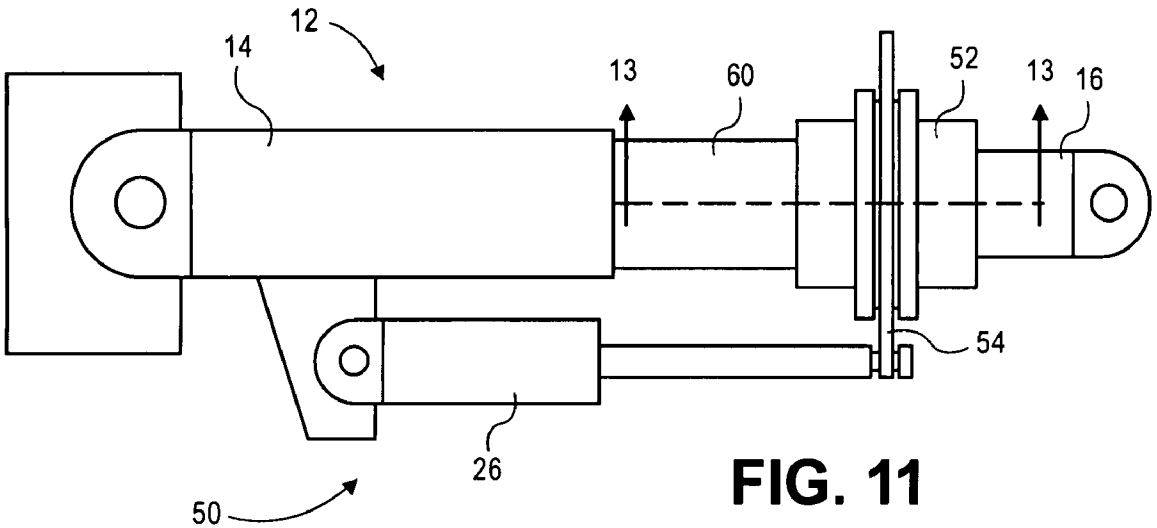
FIG. 11 is a side view of a railcar door operating mechanism with a piston lock collar in a retracted position.
Figure 12:
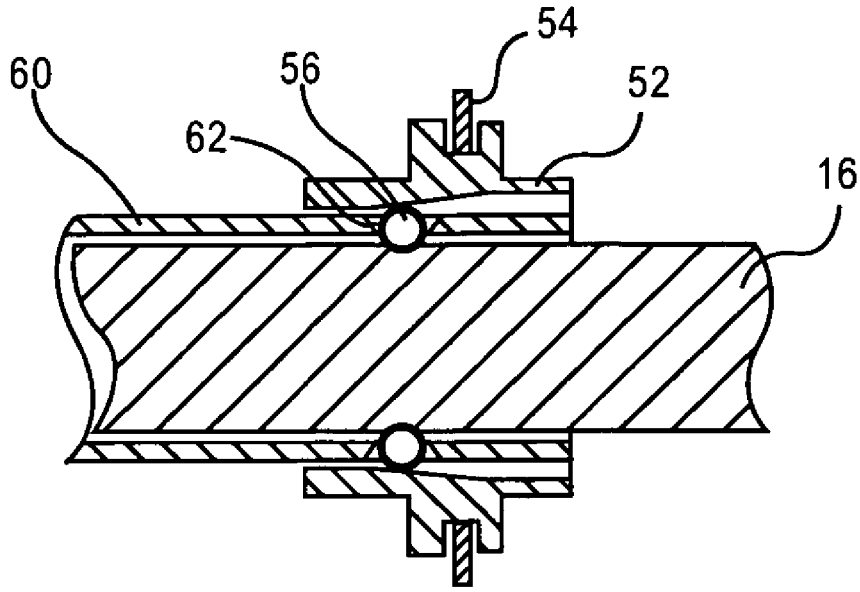
FIG. 12 is a section view of a railcar door operating mechanism with an piston lock collar in a extended position.
Figure 13:
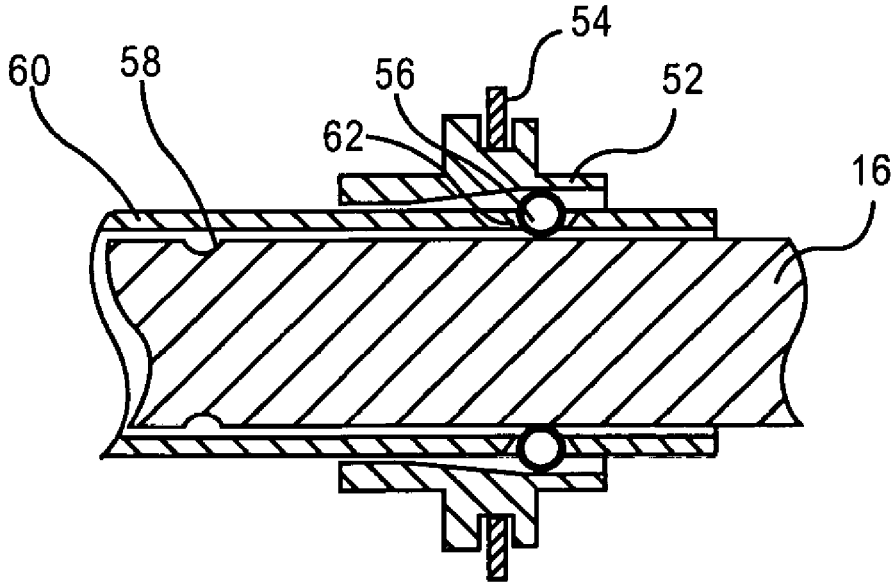
FIG. 13 is a section view of a railcar door operating mechanism with an piston lock collar in an retracted position.

As shown in FIGS. 8 and 9, particular embodiments of the present invention may also include railcar door operating mechanism 40. The operating mechanism 40 may comprise a hydraulic piston 12, which may include a barrel 14 and a rod 16, a piston lock/lock drive 42, a piston stop 44 coupled to the rod 16 and a lock drive piston 26. In order to retain railcar door 34 in a closed position, hydraulic piston 12 may be moved to an extended position, wherein the rod 16 extends out of the barrel 14. The lock drive piston 26 may be in a retracted position, thereby keeping the piston lock/lock drive 42 in a rotated closed position. While in the closed position, the piston lock/lock drive 42 may engage piston stop 44 and prevent the hydraulic piston 12 from retracting and opening the railcar door 34. To open the railcar door, the lock drive piston 26 may be extended to rotate the piston lock/lock drive 42 into an opened position. With the piston lock/lock drive 42 out of the way, the hydraulic piston 12 may then be retracted to open the railcar door 34. It should be understood by those of ordinary skill in the art, the piston lock/lock drive 42 may be of any shape and size so long as the piston lock/lock drive 42 may be moved into a closed position to lock the hydraulic piston 12 in its closed position and to into its opened position to permit the retraction of hydraulic piston 12.

The piston lock/lock drive 42 combination may be of any shape and size to accommodate the amount of travel necessary to fully open the railcar door. It should be appreciated that while the particular embodiment shown in FIGS. 8 and 9 show the hydraulic piston 12 in an extended position to close the railcar door and in a retracted position to open the railcar door, that the hydraulic piston 12 may utilize a retracted position to close the railcar door and an extended position to open the railcar door as explained earlier.

The piston stop 44 may comprise a ring, a collar, a collet, an annulet, or any other structure that may be used as a stop for inhibiting movement of the hydraulic piston 12. Additionally, the piston stop 44 may be coupled to the rod through means such as, but not limited to, a weld, a bolt, a screw and an epoxy or the piston stop 44 may integral to the rod 16 or integral to the barrel 14. The piston stop 44 may also be coupled to the frame of the railcar or to the railcar door, so long as the piston lock/lock drive 42 can engage the piston stop 44 and stop movement of the hydraulic piston 12.

As shown in FIGS. 10-13, particular embodiments of the present invention may also include a railcar door operating mechanism 50. The operating mechanism 50 may comprise a hydraulic piston 12 with a barrel 14 and a rod 16, a piston lock 52, a collar 60, lock bearings 56, bearing retainers 62, a notch 58, a lock drive 54 and a lock drive piston 26. The piston lock 52 may be a cylindrical sleeve with a tapered inner diameter. To retain hydraulic piston 12 in an extended position, lock drive piston 26 may be in an extended position thereby moving the lock drive 54 into a closed position. As the lock drive 54 moves into a closed position, it engages the piston lock 52 and moves it into a locked position. As the piston lock 52 moves into a locked position, the lock bearings 56 are compressed within the notch 58 by the tapered inner diameter of piston lock 52. The collar 60 and bearing retainers 62 ensure that the lock bearings 56 are properly placed within the notch 58. The compression of the lock bearings 56 in the notch 58 inhibits any movement of the hydraulic piston 12, thereby retaining it in a locked position. To place the hydraulic piston 12 in an unlocked position, the lock drive piston 26 may retract causing the lock drive 54 to move into an opened position. When in moving into an opened position, the lock drive 54 engages the piston lock 52 and moves the piston lock 52 into an unlocked position. The movement of the piston lock 52 into an unlocked position places the larger inner diameter of the tapered inner diameter of the piston lock 52 around the lock bearings 56, thereby freeing the lock bearings 56 from the notch 58 and allowing the lock bearings to be retained within the bearing retainers 62. This places the hydraulic piston 12 into an unlocked position and the hydraulic piston 12 may then be retracted.

It should be appreciated that while the particular embodiment shown in FIGS. 10-13 show the hydraulic piston 12 in an extended position to close the railcar door and in a retracted position to open the railcar door, that it the hydraulic piston 12 may utilize a retracted position to close the railcar door and an extended position to open the railcar door. The operating mechanism 50 may be oriented such that the hydraulic piston 12 is coupled to a frame portion of the railcar 30 on a side of the railcar door 34 such that the railcar door 34 opens away from the operating mechanism 10

It will be understood by those of ordinary skill in the art from the disclosure provided that while one lock drive piston 26 is shown per door for each of the various embodiments herein, that there may be a plurality of lock drive pistons 20 used to operate the piston lock 52. It will also be understood while lock bearings 56 being pressed into a notch 58 is shown as the method of locking the hydraulic piston 12, that other methods may be employed, such as the use of a lock washer, a shaft and hole and other methods known to restrict the movement of a hydraulic piston 12.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, while particular embodiments employ hydraulic pistons, the operating mechanism may also use pneumatic pistons, electrical actuators, any type of air or fluid piston and any combination thereof.

While the present invention has been shown to be hydraulically operated, it may also be manually operated. In such cases, the need for a lock drive and a lock drive piston may be eliminated. Additionally, the railcar door operating mechanism with piston lock may be operated automatically or semi-automatically as a railcar approaches an unloading station, whereby the system may be activated using a magnetic loop, a remote control, an on-train controller, an off-train controller or other method of starting the hydraulic flow of the system operating mechanism. The hydraulic pump may also be located on-train or may be a wayside pump.

The frame plates 28 and 38 and the doorplate 36 may be coupled to a portion of the frame and the railcar door respectively by use of, but not limited to, welds, epoxy, bolts, clamps, and other binding methods that have sufficient strength to resist failure under the loads of opening and closing the railcar door with and without a commodity loaded in the railcar. It should be understood that the operating mechanism 10 is functional even with loose impediments that may be present to inhibit the closing of the railcar door 34.

The operating mechanism 10 is shown in use with railcar doors located on the bottom side of a railcar 30, the railcar doors 34 being of the type of a rapid discharge door that functions using two separate doors that pivot open in opposite directions. It should be understood that the operating mechanism 10, according to particular embodiments of the present invention may used on various door types that are located on the underneath the railcar 30.

The invention claimed is:

1. A railcar door operating mechanism and piston lock comprising:

a hydraulic piston comprising a barrel and a rod configured to couple between a position on a railcar frame and a position on a railcar door located on the bottom side of a railcar, the hydraulic piston having an extended position whereby the railcar door is closed and a retracted position whereby the railcar door is open; and a moveable piston lock adjacent to and operatively associated with the hydraulic piston, the piston lock having a locked position, whereby the hydraulic piston movement is stopped and unlocked position, whereby the hydraulic piston movement is permitted;

wherein the piston lock is moveable into the locked position when the hydraulic piston is in the extended position and in the unlocked position when the hydraulic piston is in the retracted position.

2. The operating mechanism of claim 1, further comprising a lock drive configured to operate the piston lock.

3. The operating mechanism of claim 2, wherein the lock drive is moveable into a first position and a second position, wherein movement into the first position induces the piston lock into the unlocked position and movement into the second position induces the piston lock into the locked position.

4. The operating mechanism of claim 3, further comprising a lock drive piston configured to move the lock drive into the first position and the second position.

5. The operating mechanism of claim 4, wherein the piston lock comprises a pivotable, over-center lever arm.

6. The operating mechanism of claim 5, wherein the lock drive is a pivotable lift arm coupled to the barrel of the hydraulic piston.

7. The operating mechanism of claim 6, wherein the lift arm comprises a lift guide and a lock guide, the lift guide configured to direct the lever arm into an unlocked position and the lock guide configured to direct the lever arm into a locked position when the hydraulic piston is in the extended position.

8. The operating mechanism of claim 2, wherein the lock drive comprises at least one of a fork, a ring, a four-bar mechanism, a collar, a collet, a cam and any combination thereof, and wherein the lock drive is moveable between a first and second position.

9. The operating mechanism of claim 1, wherein the piston lock is at least one of a fork, a ring, a collar, a collet, a chuck, a pin and any combination thereof, and wherein the piston lock retains the hydraulic piston in the extended position.

10. A railcar door operating mechanism and piston lock for opening, closing and locking a railcar door, the operating mechanism comprising:

a railcar having a railcar frame and a railcar door located on the bottom side of the railcar;

a hydraulic piston comprising a barrel and a rod configured to couple between a position on the railcar frame and a position on the railcar door, the hydraulic piston being moveable between an extended position wherein the railcar door is closed and a retracted position wherein the railcar door is open; and a moveable piston lock operatively associated with the hydraulic piston, the piston lock having a locked position wherein the hydraulic piston's movement is stopped, and unlocked position wherein the hydraulic piston's movement is permitted;

wherein the hydraulic piston opens the railcar door when moving to the retracted position and closes the railcar door when moving to the extended position.

11. The operating mechanism of claim 10, further comprising a lock drive configured to operate the piston lock.

12. The operating mechanism of claim 11, wherein the piston lock is moveable into a locked position when the hydraulic piston is in the extended position to lock the railcar door closed, and moveable into an unlocked position to allow the hydraulic piston to move into the retracted position to open the railcar door.

13. The operating mechanism of claim 12, wherein the lock drive is moveable into a first position and a second position, wherein the movement into the first position induces the piston lock into the unlocked position and the movement into the second position induces the piston lock into the locked position.

14. The operating mechanism of claim 13, further comprising a lock drive piston coupled to a frame portion of the railcar and to the piston lock, the lock drive piston configured to move the lock drive into the first position and the second position.

15. The operating mechanism of claim 14, wherein the piston lock comprises a rotatable, over-center lever arm, the lever arm being coupled to the railcar door.

16. The operating mechanism of claim 15, wherein the lock drive comprises a rotatable lift arm coupled to the barrel of the hydraulic piston, the lift arm comprising a lift guide and a lock guide, the lift guide configured to move the lever arm into the unlocked position and the lock guide configured to move the lever arm into the locked position when the hydraulic piston is in the extended position.

17. The operating mechanism of claim 10, wherein the piston lock comprises at least one of a fork, a ring, a collar, a collet, a chuck, a pin and any combination thereof, wherein the piston lock has a locked position to stop movement of the hydraulic piston and an unlocked position to permit movement of the hydraulic piston;

wherein the lock drive comprises at least one of a fork, a ring, a four-bar mechanism, a collar, a collet, a cam and any combination thereof; and wherein the lock drive is moveable between a first position corresponding with the locked position of the piston lock and second position corresponding with the unlocked position of the piston lock.

18. A railcar door operating mechanism and piston lock for opening, closing and locking a railcar door, the operating mechanism comprising:

a railcar having a railcar frame and a railcar door located on the bottom side of the railcar;

a hydraulic piston comprising a barrel and a rod configured to couple between a position on the railcar frame and a position on the railcar door, the hydraulic piston having an closed position wherein the railcar door is closed and a open position wherein the railcar door is open;

a moveable piston lock operatively associated with the hydraulic piston, the piston lock having a locked position wherein the hydraulic piston's movement is stopped and unlocked position wherein the hydraulic piston's movement is permitted;

a lock drive configured to operate the piston lock, the lock drive being moveable into a first position inducing the piston lock into an unlocked position and into a second position inducing the piston lock into a locked position; and a lock drive piston coupled to a frame portion of the railcar and to the piston lock, the lock drive piston configured to move the lock drive between the first position and the second position.

* * * * *